US005281159A

United States Patent [19]

Schmidt et al.

[11] Patent Number: 5,281,159

[45] Date of Patent: Jan. 25, 1994

[54] ADAPTOR FOR MULTIPLE PIN ELECTRIAL CONNECTION

[75] Inventors: Katalin A. Schmidt, De Plaine; Jaime Lopez, Chicago, both of Ill.

[73] Assignee: Eaton Corporation, Cleveland, Ohio

[21] Appl. No.: 26,340

[22] Filed: Mar. 4, 1993

[51] Int. Cl.[5] ..... H01R 13/00

[52] U.S. Cl. ..... 439/225

[58] Field of Search ..... 439/225, 628, 645, 646, 439/651, 652

[56] References Cited

U.S. PATENT DOCUMENTS 2,965,872 12/1960 Linn ..... 439/652
3,768,062 10/1973 Michaeles ..... 439/225
4,084,869 4/1978 Yen ..... 439/651
4,125,313 11/1978 Sipp et al. ..... 439/651

*Primary Examiner*—Joseph H. McGlynn
*Attorney, Agent, or Firm*—R. A. Johnston

[57] ABSTRACT

An adaptor for permitting a switching or other device having round pin type terminals extending therefrom to be connected to a connector of the type for connection to a flat-blade type terminal pin. An upper and lower shell joined at a parting line capture a plurality of flat-blade terminal strips. Each of the strips has the end thereof extending outwardly into a shroud formed by the shells for external connection thereto. The shells have voids which expose circular flanged perforations with spring tabs which are adapted to receive round pin connectors in frictional engagement.

12 Claims, 2 Drawing Sheets

ADAPTOR FOR MULTIPLE PIN ELECTRIAL CONNECTION

BACKGROUND OF THE INVENTION

The present invention relates to plural pin electrical connection, and particularly to connection of the type wherein a plural pin-socket connector is provided on a wiring harness for connection to a device having plural pins for sockets thereon for multiple conductor connection to various circuits. Connections of this type are commonly made in automotive wiring applications where it is desired to connect a plural pin connector or plural socket connector provided on the end of a multiple conductor wiring harness to a control or accessory device such as, for example, a controller having a plurality of user operated switches or an accessory having plural circuit connections.

In automotive body wiring harness applications, it is often desirable to employ switch controllers having round pin type connecting terminals because of the ready availability of such switches and the low cost resulting from their manufacture in high volume. However, in certain automotive wiring applications, it has been found desirable to employ wiring harness connectors having flat-blade type terminals where multiple conductors are employed, and particularly where it is desired to reduce the size of the connector to a minimum. In certain automotive wiring applications, it is particularly important to minimize the size of the wiring harness connector terminal where it is required to provide an aperture or hole in a panel or portion of the body structure for insertion of the connector therethrough for connection to a control switch or other device. Consequently, wiring harness connection employing thin flat-blade type pins therein have found widespread use as a means of facilitating the assembly of the wiring connections in the vehicle during manufacture.

Thus, it has been desired to find a way or means of adapting the aforesaid flat pin type wiring harness connector for connection to switching assemblies or accessory devices which are manufactured with integrally formed round pin type electrical terminals for connection thereto.

SUMMARY OF THE INVENTION

The present invention provides an adaptor for connection of a multiple pin wiring harness connector of the type having flat-blade terminal pin-sockets to a switch or other device having a plurality of round terminal pins provided integrally thereon for electrical connection thereto. The adaptor of the present invention employs a plurality of electrically conductive flat strips which have one end portion extending outwardly from a housing for connection to a flat-blade type wiring harness connector. The opposite end of the strips are encased in between an upper and lower plastic housing shell and retained therein. Voids in the plastic housing shell expose perforated portions of the strips which are adapted to have received therein in bayonet type frictional connection the round pins of a switch or other device to be connected thereto.

DETAILED DESCRIPTION

Figure 1:
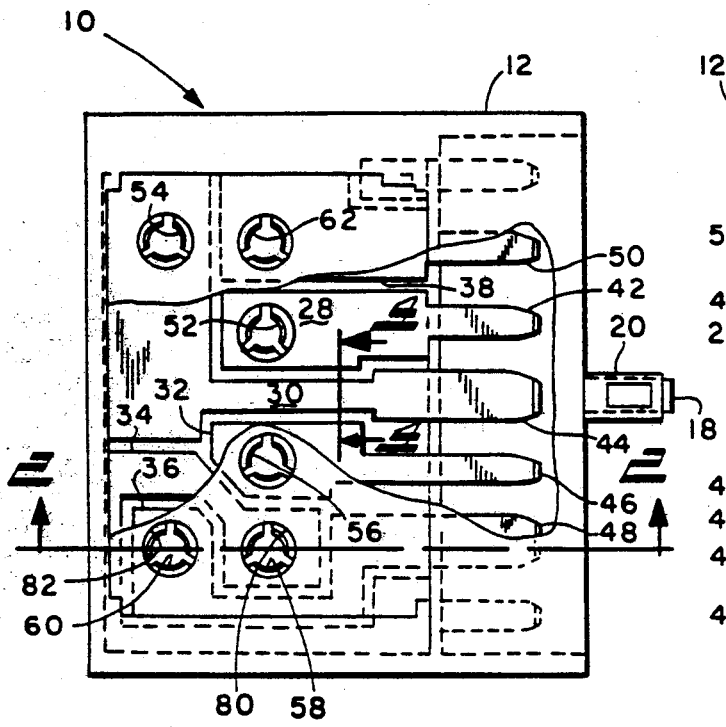
FIG. 1 is a top view of the adaptor of the present invention with portions of the cover broken away.
Figure 3:
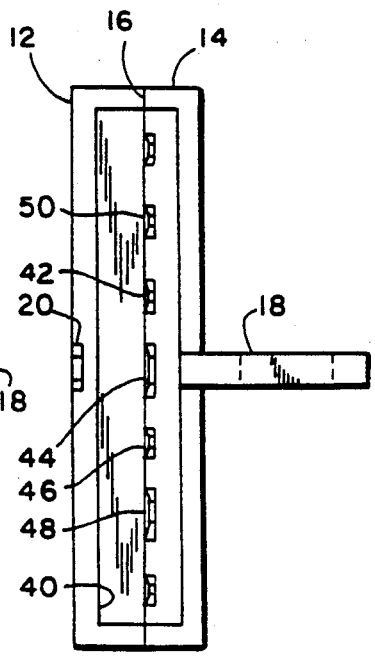
FIG. 3 is a right end view of the adaptor of FIG. 1.

Referring to FIGS. 1 through 4, the adaptor of the present invention has an upper housing shell foil illustrated with portions broken away in FIG. 1, which is assembled to a lower shell along a parting line 16 and retained thereagainst by any suitable expedient as, for example, snap-lock connectors (not shown). The upper and lower shells 12,14 are typically formed of molded plastic or other insulating material molding; and, the lower shell 14 has provided integrally formed thereon a mounting lug 18 extending therefrom which enables the adaptor to be secured to a stationary structure such that a wiring harness connector may be attached thereto, and a switching or accessory device, as will hereinafter be described in greater detail.

Figure 4:
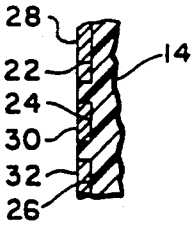
FIG. 4 is a portion of a section view taken along section-indicating lines 4—4 of FIG. 1.

Upper shell 12 has a tab 20 extending therefrom which is adapted for snap-lock connection to a wiring harness connector upon assembly thereto. Referring to FIGS. 1 and 4, lower shell 14 has a plurality of recesses formed therein, three of which are illustrated in FIG. 4 and denoted by reference numerals 22,24,26, each of which has received therein an electrical conductor strip as denoted, respectively, by reference numerals 28,30,32. Two additional strips denoted by reference numerals 34,36 are partially visible in the lower portion of FIG. 1, and an additional strip 38 is partially visible in the upper portion of FIG. 1. Portions of strip 36,34, and 48 are shown in cross-section in FIG. 2. Each of the strips 28,30,32,34,36,38 has the end portion thereof extending outwardly of the shells and into the shroud portions thereof, denoted by reference numeral 40,41, which end portions are denoted, respectively, by reference numerals 42,44,46,48,50.

Figure 2:
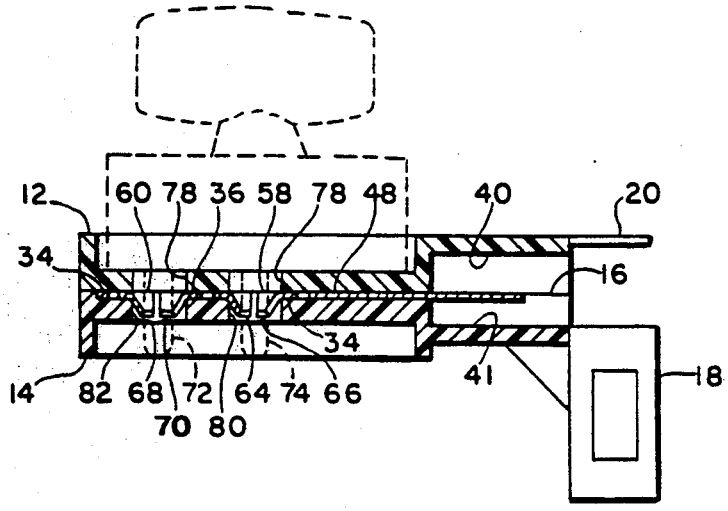
FIG. 2 is a section view, taken along section-indicating lines 2—2 of FIG. 1.

Referring to FIGS. 1 and 2, each of the strips 28,30,32,34,36,38 has a circular or round flanged perforation or hole punched therein as indicated, respectively, by the reference numerals 52,54,56,58,60,62. Each of the aforesaid punched holes has a downturned flange slotted to provide a plurality of radially resilient spring tabs, four of which tabs are illustrated in detail in FIG. 2, two for the hole 58 in strip 34 as denoted by reference numerals 64,66 and two for the punched hole 60 in strip 36, as denoted by reference numerals 68,70.

With reference to FIG. 2, the upper shell 12 and the lower shell 14 have voids or apertures formed therein for each of the punched holes to permit access thereto, and these holes are denoted, respectively, by reference numerals 76,78 and 80,82 in FIG. 2 as typical of the voids provided for in the shells for each of the punched holes.

Referring to FIG. 2, a typical switching device to be connected to is indicated in dashed outline as having a pair of round terminal pins denoted by reference numerals 72,74 extending therefrom. Pins 72,74 are received into apertures 58,60 in a manner spreading the spring tabs 64,66 and 68,70, respectively, such that the edges of the spring tabs frictionally engage the pins 72,74. It will be understood that the number arrangement of the pattern or location of the punched holes is determined by the device to be connected to; and, the array illustrated in FIG. 1 is merely typical of that arranged for accommodating a known switching device of the type employed for automotive applications.

Figure 5:
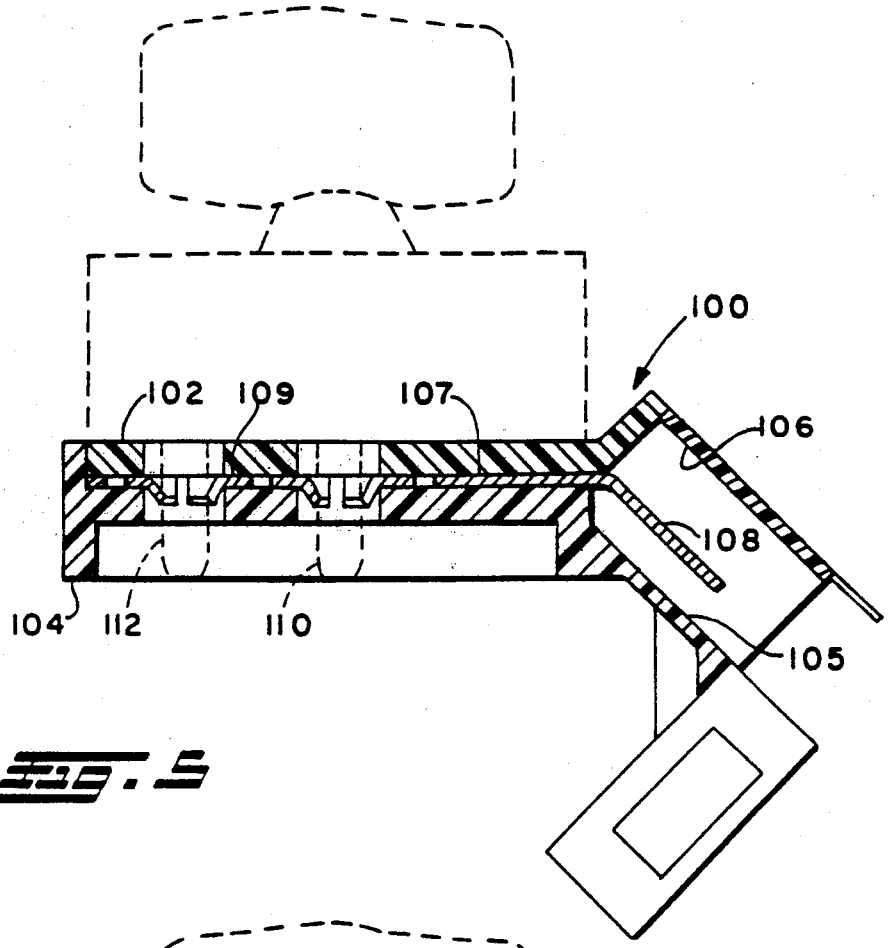
FIG. 5 is a view similar to FIG. 2 of an alternate embodiment.

Referring to FIG. 5, an alternate embodiment of the invention is indicated generally at 100, wherein the upper and lower shells 102,104 have conductor strips, such as strips 107,109 therebetween, and have the shroud portions 105,106 thereof inclined at an angle to the strips, each of which has the end portion thereof bent downwardly to extend in the shroud in parallel relationship therewith. Numeral 108 denotes typically the end of strip 107. The switching device has round terminal pins denoted by numerals 110,112 received in the punched holes provided in the conductive strip 107,108 and engaged by spring tabs in a manner similar to the embodiment of FIG. 1.

Figure 6:
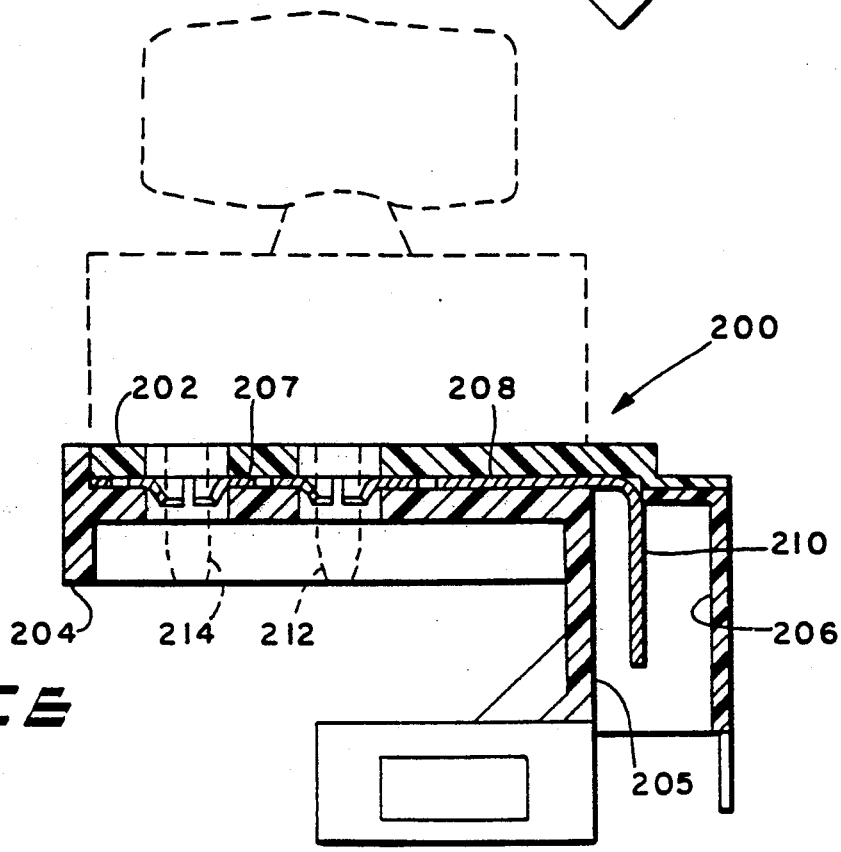
FIG. 6 is a view similar to FIG. 2 of another embodiment.

Referring to FIG. 6, another embodiment of the invention is illustrated generally at 200, wherein the upper shell 202 and lower shell 204 have the shroud portions 205,206 thereof disposed at right angles to the conductive strips 207,208, each with its end portion extending at right angles thereto and into the shrouds 205,206 in parallel relationship therewith. Reference numeral 210 denotes the end portion typically of strip 208.

A switching device is indicated in dashed outline and has round terminal pins 212,214, which are received in the flanged perforations of the terminal strips 207,208 in a manner similar to that of the embodiment of FIG. 1 for frictional connection to the strip.

The present invention thus provides an adaptor for connecting a switching or other device having round terminal pins extending therefrom to a wiring harness connection of the type having a plurality of flat-blade type pins disposed in an array therein. The adaptor of the present invention has a plurality of conductor strips captured between an upper and lower shell which form a shroud for the ends of the strips extending outwardly therefrom for connection to a wiring harness connector having sockets therein of the type adapted for flat-blade type pins. The upper and lower shells have apertures or voids therein which expose flanged perforations or punched holes in each of the strips which have spring tabs provided therearound to engage the round pin type terminals of the device to be connected to when the terminals are received therein. The present invention thus provides an adaptor which is low in manufacturing cost and easy to assemble, and which facilitates connection of round pin type electrical terminals to a wiring harness connector adapted for connection to flat-blade type terminal pins.

Although the invention has been hereinabove described with respect to the illustrated embodiments, it will be understood that the invention is capable of modification and variation, and is limited only by the following claims.

We claim:

1. An electrical terminal adaptor comprising:

(a) a housing formed of electrically non-conductive material;

(b) a first array of individual electrically conductive terminal strips, each having a flat-blade type end portion thereof extending externally of said housing and an opposite end portion thereof extending interiorly of said housing, each having a generally circular flanged perforation therein; said housing having corresponding apertures therein to permit free access to said perforations, wherein said perforations are arranged in a second array and are adapted to each receive in frictional engagement inserted therein a round pin electrical terminal.

2. The adaptor defined in claim 1, wherein said first array is arranged at generally right angles to the direction of engagement of said perforations.

3. The adaptor defined in claim 1, wherein said externally extending portions of said terminals are formed at generally right angles to said opposite end portions.

4. The adaptor defined in claim 1, wherein said externally extending portions of said terminals is formed at an angle with said opposite end portions.

5. The adaptor defined in claim 1, wherein said housing comprises plastic material.

6. The adaptor defined in claim 1, wherein said externally extending portions of said terminals are disposed in a planar array.

7. The adaptor defined in claim 1, wherein said perforations are formed in a planar array.

8. The adaptor defined in claim 1, wherein said housing includes an upper and lower shell joined together along a parting line.

9. The adaptor defined in claim 1, wherein said flat-blade terminals are disposed in a planar array, with said housing comprising an upper and lower shell joined along a parting line generally parallel to said planar array.

10. The adaptor defined in claim 1, wherein said housing includes a shroud portion surrounding said end portions of said flat-blade strip.

11. The adaptor defined in claim 1, wherein said housing includes an upper and lower shell joined together along a parting line with said lower shell having a plurality of recesses therein at said parting line with each of said conductive strips received in one of said recesses.

12. The adaptor defined in claim 1, wherein said flanged perforations include a plurality of spring tabs.

* * * * *